US009697768B2

(12) United States Patent
In et al.

(10) Patent No.: US 9,697,768 B2
(45) Date of Patent: Jul. 4, 2017

(54) ORGANIC LIGHT-EMITTING DISPLAY APPARATUS

(71) Applicant: SAMSUNG DISPLAY CO., LTD., Yongin, Gyeonggi-Do (KR)

(72) Inventors: Haijung In, Yongin (KR); Boyong Chung, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 69 days.

(21) Appl. No.: 14/747,315

(22) Filed: Jun. 23, 2015

(65) Prior Publication Data

US 2016/0210906 A1 Jul. 21, 2016

(30) Foreign Application Priority Data

Jan. 21, 2015 (KR) ..... 10-2015-0010026

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2300/0866* (2013.01); *G09G 2310/0218* (2013.01); *G09G 2310/0251* (2013.01); *G09G 2310/0256* (2013.01); *G09G 2320/0238* (2013.01)

(58) Field of Classification Search
CPC ..... G09G 3/3291; G09G 2310/027
See application file for complete search history.

(56) References Cited

U.S. PATENT DOCUMENTS

2009/0009441 A1* 1/2009 Yamamoto ..... G09G 3/3233 345/80
2011/0279437 A1 11/2011 Komiya et al.
2011/0316892 A1 12/2011 Sung et al.
2012/0249615 A1 10/2012 Lee
2014/0009456 A1* 1/2014 Kim ..... G09G 3/3208 345/212
2014/0062978 A1 3/2014 Shin
2014/0071028 A1 3/2014 Han
(Continued)

FOREIGN PATENT DOCUMENTS

KR 10-2011-0124656 11/2011
KR 10-2012-0000887 1/2012
(Continued)

*Primary Examiner* — Lixi C Simpson
(74) *Attorney, Agent, or Firm* — Lee & Morse, P.C.

(57) ABSTRACT

A display apparatus includes a plurality of pixel circuits, each outputting a driving current to an output node connected to an organic light-emitting diode based on a data signal. Each pixel circuit sequentially operate in an anode initialization period, a threshold voltage compensation period, a data write period, and an emission period. The pixel circuits are arranged in in multiple rows and multiple columns, and each pixel circuit includes an anode initialization transistor to output an initialization voltage to the output node based on a first control signal. A first control line connected to the anode initialization transistor of a pixel circuit in an odd row is different from the first control line connected to the anode initialization transistor of a pixel circuit in an even row.

19 Claims, 8 Drawing Sheets

(56) References Cited

U.S. PATENT DOCUMENTS

| | | | | |
|---|---|---|---|---|
| 2014/0285408 | A1* | 9/2014 | Yumoto | G09G 3/3233 345/76 |
| 2014/0307012 | A1* | 10/2014 | Kishi | G09G 3/3233 345/691 |
| 2016/0189627 | A1* | 6/2016 | Park | G09G 3/3291 345/78 |

FOREIGN PATENT DOCUMENTS

| | | |
|---|---|---|
| KR | 10-2012-0110413 | 10/2012 |
| KR | 10-2014-0028379 | 3/2014 |
| KR | 10-2014-0033790 | 3/2014 |

* cited by examiner

ORGANIC LIGHT-EMITTING DISPLAY APPARATUS

CROSS-REFERENCE TO RELATED APPLICATION

Korean Patent Application No. 10-2015-0010026, filed on Jan. 21, 2015, and entitled, "Organic Light-Emitting Display Apparatus," is incorporated by reference herein in its entirety.

BACKGROUND

1. Field

One or more embodiments herein relate to organic light-emitting display apparatus.

2. Description of the Related Art

A variety of flat panel displays have been developed. Examples include liquid crystal displays, field emission displays, plasma display panels, and organic light-emitting displays. These displays are lighter and larger than cathode ray tube displays.

In an organic light-emitting display, pixels emit light when electrons and holes combine in an emission layer that includes organic compounds. This type of display has fast response time, low power consumption, and excellent brightness, color purity, and driving voltage characteristics.

In operation, light is emitted from color pixels to form an image. Each pixel emits light with a brightness that is based on a data voltage received by a pixel circuit. The pixel circuit includes a plurality of transistors and one or more storage capacitors for controlling driving current supplied to an organic light emitting diode (OLED) of the pixel.

SUMMARY

In accordance with one or more embodiments, an organic light-emitting display apparatus includes a plurality of pixel circuits, each of the pixel circuits to receive a data signal and to output a driving current to an output node based on the data signal, the pixel circuits to sequentially operate in an anode initialization period, a threshold voltage compensation period, a data write period, and an emission period; and a plurality of organic light-emitting diodes to emit light based on the driving currents transferred through the output nodes of respective ones of the pixel circuits, wherein: the pixel circuits are in multiple rows and multiple columns, each of the pixel circuits includes an anode initialization transistor to output an initialization voltage to the output node based on a first control signal received through a first control line, and the first control line connected to the anode initialization transistor of a pixel circuit in an odd row is different from the first control line connected to the anode initialization transistor of a pixel circuit in an even row.

Each of the pixel circuits may include a capacitor, a driving transistor, a switching transistor, and an emission control transistor, the capacitor has a first electrode connected to a first node and a second electrode connected to the output node, the driving transistor has a gate electrode connected to the first node, a first electrode connected to a second electrode of the emission control transistor, and a second electrode connected to the output node, the switching transistor has a gate electrode connected to a scan line, a first electrode connected to a data line, and a second electrode connected to the first node, and the emission control transistor has a gate electrode connected to a second control line and a first electrode connected to a first power supply.

A second control line connected to an emission control transistor of the pixel circuit in the odd row may be different from a second control line connected to an emission control transistor of the pixel circuit in the even row. The anode initialization transistor may have a first electrode connected to the data line and a second electrode connected to the output node, and the anode initialization transistor may output a voltage from the data line to the output node based on the first control signal.

The data write period of the pixel circuit in the odd row may overlap the emission period of the pixel circuit in the even row. The data write period of the pixel circuit in the even row may overlap the emission period of the pixel circuit in the odd row. The anode initialization transistor may output the initialization voltage to the output node during the anode initialization period based on the first control signal.

During the threshold voltage compensation period, the emission control transistor may be turned on based on a second control signal received through the second control line and may output a first voltage received through the first power supply to the first electrode of the driving transistor, and the switching transistor may output a reference voltage to the first node based on a scan signal received through the scan line.

The reference voltage may be set such that a level of a voltage applied to the output node is lower than a level of a turn-on voltage of the organic light-emitting diode. A level of the initialization voltage may be lower than a level of a turn-on voltage of the organic light-emitting diode.

In accordance with one or more other embodiments, an organic light-emitting display apparatus includes a plurality of pixel circuits, each of the pixel circuits to receive a data signal and to output a driving current to an output node based on the data signal, the pixel circuits to sequentially operate in an anode initialization period, a threshold voltage compensation period, a data write period, and an emission period; and a plurality of organic light-emitting diodes to emit light based on the driving currents transferred through the output nodes of respective ones of the pixel circuits, wherein: the pixel circuits are in multiple rows and multiple columns, each of the pixel circuits includes an anode initialization transistor having a first electrode connected to an initialization voltage line, a second electrode connected to the output node, and a gate electrode connected to a first control line, the anode initialization transistor to output an initialization voltage from the initialization voltage line to the output node based on a first control signal received through the first control line, and a first control line connected to an anode initialization transistor of a pixel circuit in an odd row is different from a first control line connected to an anode initialization transistor of a pixel circuit in an even row.

The data write period of the pixel circuit in the odd row may overlap the emission period of the pixel circuit in the even row, and the data write period of the pixel circuit in the even row may overlap the emission period of the pixel circuit in the odd row. An initialization voltage may be applied to the initialization voltage line during the anode initialization period, and a level of the data signal may be substantially equal to a level of a reference voltage during the threshold voltage compensation period. The reference voltage may be set such that a level of a voltage applied to the output node is lower than a level of a turn-on voltage of the organic light-emitting diode. A level of the initialization voltage may be lower than a level of a turn-on voltage of the organic light-emitting diode.

In accordance with one or more other embodiments, a display includes a first pixel circuit to output a driving current to a first light emitter; and a second pixel circuit to output a driving current to a second light emitter; wherein the first pixel circuit is in an odd row and the second pixel circuit is in an even row, each of the first and second pixel circuits including an anode initialization transistor to output an initialization voltage to an output node based on a first control signal from a first control line, the first control line connected to the first pixel circuit different from the first control line connected to the second pixel circuit.

Each of the first and second pixel circuits may operate in an anode initialization period, a threshold voltage compensation period, a data write period, and an emission period. The anode initialization transistor of each of the first and second pixel circuits may output the initialization voltage during the anode initialization period. A level of the initialization voltage may be lower than a level of a turn-on voltage of the light emitter in each of the first and second pixel circuits. A data write period of one of the first or second pixel circuits may overlap an emission period of the other of the first or second pixel circuits.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
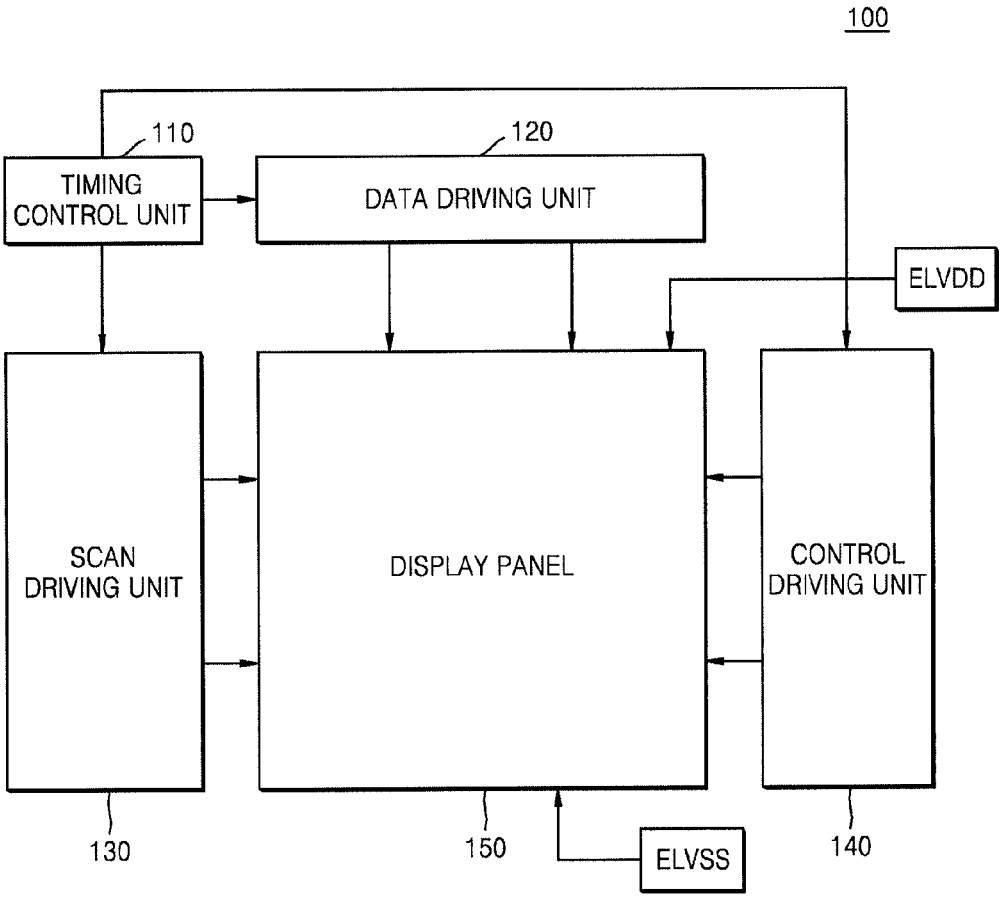
FIG. 1 illustrates an embodiment of an organic light-emitting display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of an organic light-emitting display apparatus 100 which includes a timing control unit 110, a data driving unit 120, a scan driving unit 130, a control driving unit 140, and a display panel 150. The organic light-emitting display apparatus 100 includes a first power supply ELVDD and a second power supply ELVSS.

The timing control unit 110 controls the data driving unit 120, the scan driving unit 130, and the control driving unit 140 based on control (e.g., synchronization) signals. The timing control unit 110 generates new data by changing bits of externally applied pixel data. The new data may compensate for mobility and a threshold voltage of a driving transistor in each of the pixels.

The data driving unit 120 generates data signals corresponding to data from the timing control unit 110. The data driving unit 120 supplies data signals to data lines in synchronization with scan signals from the scan driving unit 130 through scan lines during one frame time of a data write period. In addition, the data driving unit 120 supplies an initialization voltage and/or a reference voltage to the data lines. The reference voltage is used for initializing the gate electrode of the driving transistor and is set to a predetermined voltage. The initialization voltage is used for initializing anode electrodes of the OLEDs in the pixels and is set to a voltage at which the OLEDs do not emit light.

Figure 4:
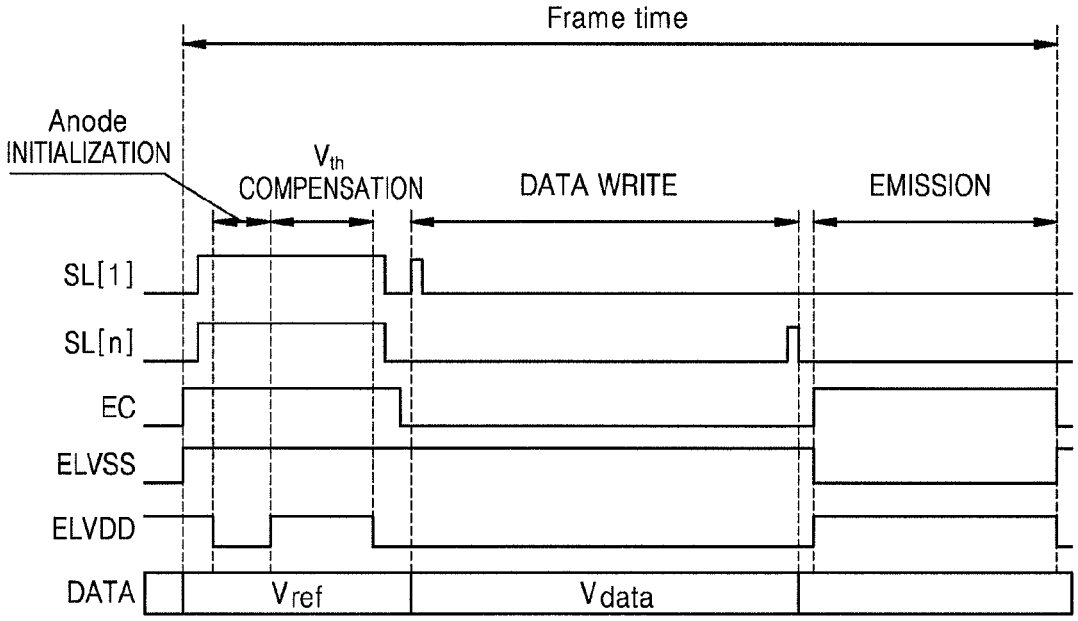
FIG. 4 illustrates an example of control signals for the pixel circuit.

The scan driving unit 130 supplies scan signals to the scan lines. For example, as illustrated in FIG. 4, the scan driving unit 130 may supply the scan signals to the scan lines during one frame time of an anode initialization period and a threshold voltage ($V_{th}$) compensation period. The scan driving unit 130 may sequentially supply the scan signals to the scan lines during a data write period. The scan signal is set to a voltage sufficient to turn on the transistors in the pixels. For example, when PMOS transistors are in the pixels, the scan signal is set to a low voltage. When NMOS transistors are in the pixels, the scan signal is set to a high voltage.

The control driving unit 140 supplies control signals to one or more control lines, which, for example, may be commonly connected to the pixels. The control driving unit 140 may supply an emission control signal to turn on emission control transistors in the pixels during the emission period.

The display panel 150 includes the pixels in regions partitioned by the scan lines and the data lines. The pixels charge data signals during the data write period and emit light based on the charged data signals during the emission period. The pixels control an amount of current flowing from the first power supply ELVDD through the OLED to the second power supply ELVSS based on the data signal.

In FIG. 1, the control lines receive the control signals from the control driving unit 140. In another embodiment, the control lines may receive the control signals from the scan driving unit 130.

Figure 2:
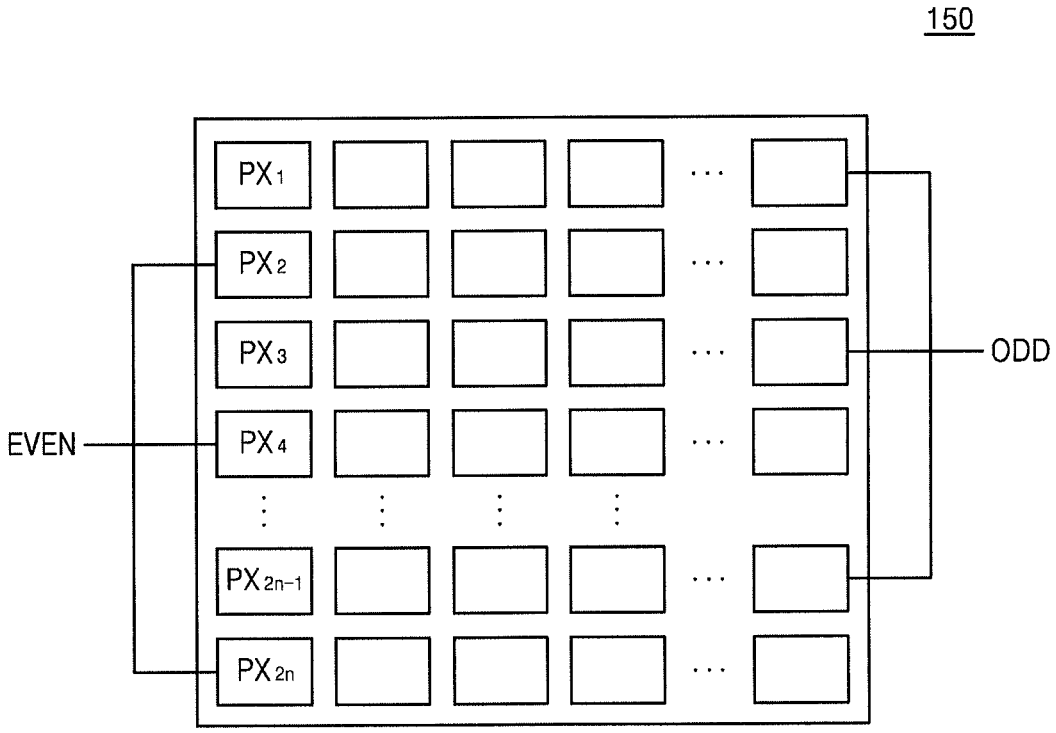
FIG. 2 illustrates an embodiment of a display panel.

FIG. 2 illustrates an arrangement of the pixels in the display panel 150.

Referring to FIG. 2, the display panel 150 includes the pixels in regions partitioned by the scan lines and the data lines. The pixels are arranged in multiple rows and multiple columns. Pixels $PX_1$ to $PX_{2n}$ in the left first row will be described in greater detail below.

The pixels include pixels in odd rows and pixels in even rows. The scan lines may be between pixels in a first direction, and the data lines may be between pixels in a second direction. The first direction may be a horizontal direction and the second direction may be a vertical direction, or vice versa.

When apparatus 100 is a simultaneous emission type organic light-emitting display apparatus, a scan operation may be sequentially performed on the scan lines in the first direction. In the scan operation, data signals of an image frame are sequentially written to first pixels connected to the scan lines. The first pixels may be in the first row, e.g., pixel $PX_1$ and subsequent pixels in the horizontal direction from the pixel $PX_1$.

When writing of data to the first pixels has been completed, data is written to second pixels. The second pixels may be pixels in the second row, e.g., pixel $PX_2$ and subsequent pixels in the horizontal direction from the pixel $PX_2$.

The scan line connected to the first pixels may be different from the scan line connected to the second pixels. For example, the scan lines may include scan lines from the first scan line connected to the pixels in the first row (pixel $PX_1$ and subsequent pixels in the horizontal direction from the pixel $PX_1$) to the $2n^{th}$ scan line connected to the pixels in the last row (pixel $PX_{2n}$ and subsequent pixels in the horizontal direction from the pixel $PX_{2n}$).

Figure 3:
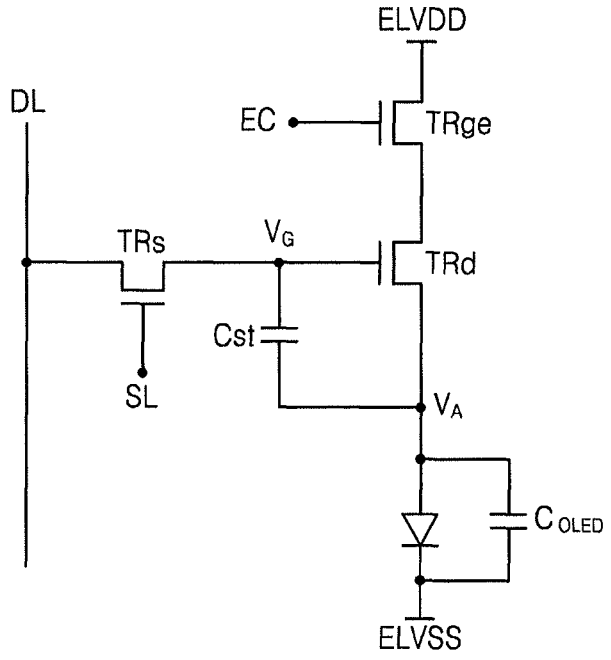
FIG. 3 illustrates an embodiment of a pixel circuit.

FIG. 3 illustrate an embodiment of a pixel circuit of the organic light-emitting display apparatus 100. Referring to FIG. 3, the pixel circuit included a driving transistor $TR_d$, an emission control transistor $TR_{ge}$, a switching transistor $TR_s$, capacitor Cst, and an OLED. The pixel circuit may be used, for example, in a simultaneous emission type organic light-emitting display apparatus. The pixel circuit may be representative of the pixels circuits in the other pixels.

In the pixel circuit, the driving transistor $TR_d$ has a gate electrode connected to a second electrode of the switching transistor $TR_s$ and a first electrode of the capacitor $C_{st}$. A first electrode of the driving transistor $TR_d$ is connected to a second electrode of the emission control transistor $TR_{ge}$, and a second electrode of the driving transistor $TR_d$ is connected to an anode electrode of the OLED.

The switching transistor $TR_s$ has a first electrode is connected to a data line DL, and a gate electrode of the switching transistor $TR_s$ is connected to a scan line SL.

The emission control transistor $TR_{ge}$ has a first electrode connected to the first power supply ELVDD and a gate electrode connected to an emission control line and receives an emission control signal EC.

A second electrode of the capacitor $C_{st}$ is connected to the anode electrode of the OLED and the second electrode of the driving transistor $TR_d$ through an output node. A cathode electrode of the OLED is connected to the second power supply ELVSS.

A voltage $V_G$ of the gate node corresponds to a voltage supplied from the data line DL through the switching transistor $TR_s$. The switching transistor $TR_s$ is turned on based on the scan signal supplied from the scan line SL and outputs a voltage supplied from the data line DL to the gate node.

The capacitor $C_{st}$ is charged with a voltage applied to the gate node. The voltage charged in the capacitor $C_{st}$ corresponds to an anode voltage $V_A$ of the OLED.

The emission control transistor $TR_{ge}$ is turned on based on the emission control signal EC from the emission control line and outputs a voltage of the first power supply ELVDD to the driving transistor $TR_d$.

A current corresponding to the voltage of the first power supply ELVDD, a threshold voltage of the driving transistor $TR_d$, and a data voltage supplied from the data line DL flows through the OLED, and the OLED emits light corresponding to the current.

FIG. 4 illustrates an example of control signals for the pixel circuit of FIG. 3. The control signals include signals and voltages applied to the pixel circuit of FIG. 3 during one frame time. In FIG. 4, the vertical axis represents the first scan line SL[1] connected to the pixels in the first row from above, the $n^{th}$ scan line SL[n] connected to the pixels in the last row, the emission control signal EC, the voltage of the second power supply ELVSS, the voltage of the first power supply ELVDD, and the data signal DATA.

The frame time may be divided into an anode initialization period, a threshold voltage ($V_{th}$) compensation period, a data write period, and an emission period. In the anode initialization period, the voltage of the first power supply ELVDD is reduced to a low voltage to initialize the anode voltage $V_A$ to a low voltage. At this time, the emission control signal EC is maintained at a high level so that the emission control transistor $TR_{ge}$ maintains a turned-on state. The data signal has a level of a reference voltage $V_{ref}$.

In the threshold voltage ($V_{th}$) compensation period, the data signal is set to a level of the reference voltage $V_{ref}$ so that a level of a gate node voltage $V_G$ becomes equal to the level of the reference voltage $V_{ref}$. The anode voltage $V_A$ may therefore have a level of $V_{ref}-V_{th}$, and thus the threshold voltage of the driving transistor $TR_d$ is compensated.

In the data write period, data voltages are sequentially written to the gate nodes of the pixels. At this time, data voltages are sequentially written to pixels respectively connected to the first to nth scan lines SL[1] to SL[n].

In the emission period, since the emission control signal EC has a high voltage, a high voltage of the first power supply ELVDD is supplied to the pixel circuit by the emission control transistor $TR_{ge}$, a current corresponding to the data voltage written to each pixel is supplied to the OLED through the driving transistor $TR_d$, and the OLED emits light based on the magnitude of the current supplied through the driving transistor $TR_d$.

Since such a simultaneous emission type pixel circuit has a sufficient threshold voltage compensation time, the threshold voltage compensation is facilitated and IR-drop compensation is achieved.

However, in the simultaneous emission type pixel circuit as illustrated in FIG. 3, as the resolution of the display panel 150 and the size of the display panel 150 increase, the number of pixels in the horizontal direction increases and the load of the scan lines and the data lines increases, thereby causing an increase in RC delay. Consequently, the data write time increases and the emission time decreases. Due to this decrease in emission time, light with higher brightness may be emitted during the emission period. However, this results in an increase in emission current.

When the emission current increases, IR-drop between ELVDD and ELVSS increases. Thus, the power supply voltage may be increased, thereby resulting in an increase in power consumption.

Figure 5:
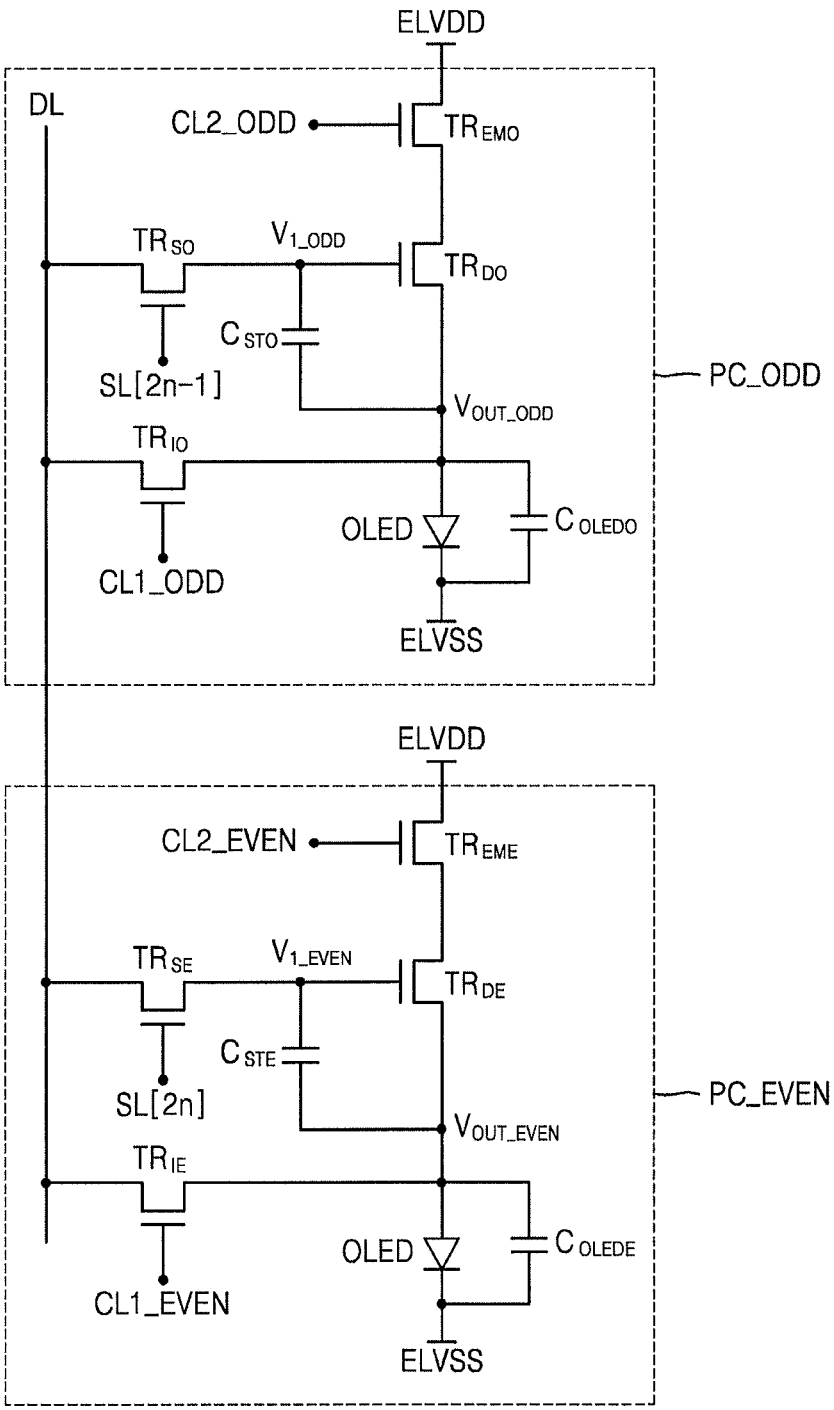
FIG. 5 illustrates an embodiment of pixel circuits.

FIG. 5 illustrates an embodiment of pixel circuits PC_ODD and PC_EVEN respectively disposed in an odd row and an even row. The two pixel circuits PC_ODD and PC_EVEN are in the same column, share one data line DL, and have the same structure.

The pixel circuit PC_ODD in the odd row receives a data signal and outputs a driving current corresponding to the data signal to an output node $V_{OUT_ODD}$. As described above with reference to FIGS. 1 and 2, the display panel 150 includes a plurality of pixel circuits PC_ODD in rows and columns. In addition, the pixel circuit PC_ODD is included in the organic light-emitting display apparatus together with a plurality of OLEDs that emit light according to the driving current transferred through the output node $V_{OUT_ODD}$.

The pixel circuit PC_ODD further includes an anode initialization transistor $TR_{IO}$ in addition to the pixel circuit of FIG. 3. The anode initialization transistor $TR_{IO}$ is connected to the output node $V_{OUT_ODD}$ and outputs an initialization voltage to the output node $V_{OUT_ODD}$ based on a first control signal received through a first control line CL1_ODD. The anode initialization transistor $TR_{IO}$ has a first electrode connected to the data line DL and a second electrode connected to the output node $V_{OUT_ODD}$. The anode initialization transistor $TR_{IO}$ outputs a voltage applied from the data line DL to the output node $V_{OUT_ODD}$ based on the first control signal.

As in the pixel circuit of FIG. 3, the pixel circuit PC_ODD includes a capacitor $C_{STO}$, a driving transistor $TR_{DO}$, a switching transistor $TR_{SO}$, and an emission control transistor $TR_{EMO}$. A first electrode of the capacitor $C_{STO}$ is connected to a first node $V_{1_ODD}$ and a second electrode of the capacitor $C_{STO}$ is connected to the output node $V_{OUT_ODD}$. A gate electrode of the driving transistor $TR_{DO}$ is connected to the first node $V_{1_ODD}$ and a second electrode of the driving transistor $TR_{DO}$ is connected to the output node $V_{OUT_ODD}$.

The switching transistor $TR_{SO}$ has a gate electrode connected to a scan line SL[2*n*−1], a first electrode of the switching transistor $TR_{SO}$ is connected to the data line DL, and a second electrode of the switching transistor $TR_{SO}$ is connected to the first node $V_{1_ODD}$. The emission control transistor $TR_{EMO}$ has a gate electrode connected to a second control line CL2_ODD and a first electrode connected to the first power supply ELVDD. The gate electrode of the emission control transistor $TR_{EMO}$ is connected to the second control line CL2_ODD and receives a second control signal.

The pixel circuit PC_EVEN in the even row receives a data signal and outputs a driving current corresponding to the data signal to an output node $V_{OUT_EVEN}$. As described above with reference to FIGS. 1 and 2, the display panel 150 includes a plurality of pixel circuits PC_EVEN in rows and columns. In addition, the pixel circuit PC_EVEN is included in the organic light-emitting display apparatus together with a plurality of OLEDs that emit light according to the driving current transferred through the output node $V_{OUT_EVEN}$.

The pixel circuit PC_EVEN further includes an anode initialization transistor $TR_{IE}$ in addition to the pixel circuit of FIG. 3. The anode initialization transistor $TR_{IE}$ is connected to the output node $V_{OUT_EVEN}$ and outputs an initialization voltage to the output node $V_{OUT_EVEN}$ based on a first control signal received through a first control line CL1_EVEN. The anode initialization transistor $TR_{IE}$ has a first electrode connected to the data line DL and a second electrode connected to the output node $V_{OUT_EVEN}$. The anode initialization transistor $TR_{IE}$ outputs a voltage applied from the data line DL to the output node $V_{OUT_EVEN}$ based on the first control signal.

As in the pixel circuit of FIG. 3, the pixel circuit PC_EVEN includes a capacitor $C_{STE}$, a driving transistor $TR_{DE}$, a switching transistor $TR_{SE}$, and an emission control transistor $TR_{EME}$. The capacitor $C_{STE}$ has a first electrode connected to a first node $V_{1_EVEN}$ and a second electrode connected to the output node $V_{OUT_EVEN}$.

The driving transistor $TR_{DE}$ has a gate electrode connected to the first node $V_{1_EVEN}$ and a second electrode connected to the output node $V_{OUT_EVEN}$.

The switching transistor $TR_{SE}$ has a gate electrode connected to a scan line SL[2*n*], a first electrode connected to the data line DL, and a second electrode connected to the first node $V_{1_EVEN}$. A gate electrode of the emission control transistor $TR_{EME}$ is connected to a second control signal CL2_EVEN and a first electrode of the emission control transistor $TR_{EME}$ is connected to the first power supply ELVDD. The gate electrode of the emission control transistor $TR_{EME}$ is connected to the second control line CL2_EVEN and receives a second control signal.

Figure 6:
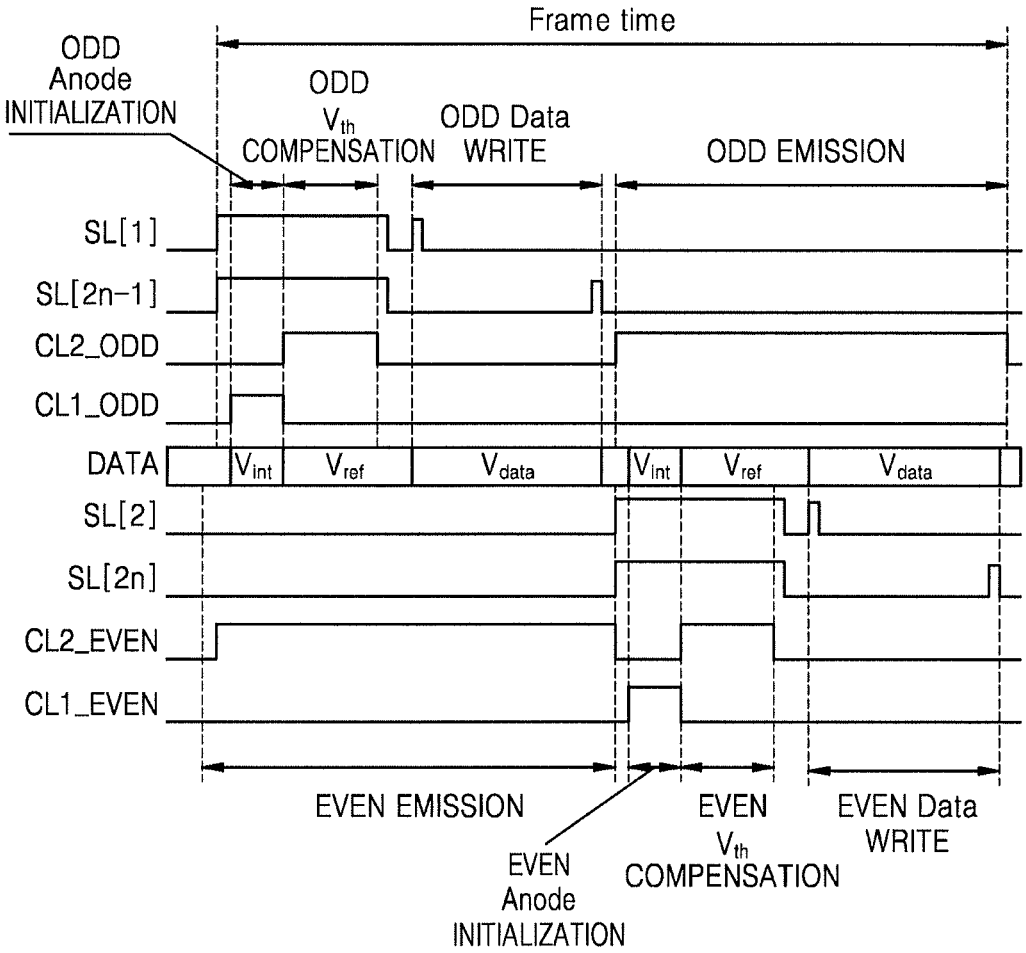
FIG. 6 illustrates an example of control signals for the pixel circuits.

FIG. 6 illustrates an example of control signals for the pixel circuits PC_ODD and PC_EVEN in FIG. 5. In FIG. 6, the driving waveform of the pixel circuit PC_ODD in the odd row is illustrated in the upper side and the driving waveform of the pixel circuit PC_EVEN in the even row is illustrated in the lower side.

Referring to FIG. 6, the pixel circuits PC_ODD and PC_EVEN sequentially have an anode initialization period, a threshold voltage ($V_{th}$) compensation period, a data (odd data/even data) write period, and an emission (odd emission/even emission) period.

The emission period of the pixel circuit PC_ODD in the odd row may not overlap the emission period of the pixel circuit PC_EVEN in the even row. For example, operation during one frame time is performed in the order of the odd anode initialization, an odd threshold voltage ($V_{th}$) compensation, an odd data writing, an odd emission, an even anode initialization, an even threshold voltage ($V_{th}$) compensation, an even data writing, and an even emission. However, the emission period of the pixel circuit PC_ODD in the odd row may overlap the emission period of the pixel circuit PC_EVEN in the even row.

Operation of the pixel circuit PC_ODD in the odd row will now be described.

During the anode initialization period, a voltage of a high level is applied to all the scan lines SL[1], SL[3], . . . , SL[2*n*−1] and all the switching transistors $TR_{SO}$ are turned on. At this time, the second control signal of a low level is applied through the second control line CL2_ODD and all the emission control transistors $TR_{EMO}$ are turned off. The first control signal of a high level is applied through the first control line CL1_ODD and the anode initialization transistor $TR_{IO}$ is turned on. Since a low initialization voltage $V_{int}$ is applied to the data line DL, the output node $V_{OUT_ODD}$ is initialized to the initialization voltage $V_{int}$. The initialization voltage $V_{int}$ is set to a voltage lower than a turn-on voltage of the OLED so that the OLED does not emit light.

In the threshold voltage ($V_{th}$) compensation period, since the first control signal of the low level is applied through the first control line CL1_ODD, the anode initialization transistor $TR_{IO}$ is turned off. Since the second control signal of the high level is applied through the second control line CL2_ODD, the emission control transistor $TR_{EMO}$ is turned off. Since the reference voltage $V_{ref}$ is applied to the data line DL, the voltage of the first node $V_{1_ODD}$ becomes the reference voltage $V_{ref}$.

At this time, a voltage of $V_{ref}-V_{th}$ is applied to the output node $V_{OUT_ODD}$ by source follow. The voltage of $V_{ref}-V_{th}$ applied to the output node $V_{OUT_ODD}$ is set to a voltage lower than a turn-on voltage of the OLED so that the OLED does not emit light.

During the data write period, the control signal of the low level is applied to both the first control line CL1_ODD and the second control line CL2_ODD. Thus, both the anode initialization transistor $TR_{IO}$ and the emission control transistor $TR_{EMO}$ are turned off.

The voltage of the high voltage is sequentially applied to the scan lines SL[1], SL[3], . . . , SL[2*n*−1], and data voltages Vdata are sequentially applied to the first node V1_ODD. At this time, due to a coupling between the capacitor $C_{STO}$ and the capacitor $C_{OLEDO}$ of the OLED, the voltage of the output node $V_{OUT_ODD}$ may be determined based on Equation (1).

$$V_{OUT_ODD} = V_{ref} - V_{th} + \frac{C_{STO}}{C_{STO} + C_{OLEDO}}(V_{data} - V_{ref}) \quad (1)$$

During the emission period, the voltages of the low level are applied to all the scan lines SL[1], SL[3], . . . , SL[2*n*−1] and the first control line CL1_ODD, so that the switching transistor $TR_{SO}$ and the anode initialization transistor $TR_{IO}$ are turned off. The voltage of the high voltage are applied to the second control line CL2_ODD, so that the emission control transistor $TR_{EMO}$ is turned on.

The current generated in the driving transistor $TR_{DO}$ is output to the OLEDs through the output node $V_{OUT_ODD}$, so that the OLEDs in the odd row emit light.

The magnitude of current flowing through the OLED is proportional to $(V_{data}-V_{OUT_ODD}-V_{th})^2$. Therefore, the emission current, which compensates for the threshold voltage of the driving transistor $TR_{DO}$, flows through the OLED, thereby exhibiting uniform brightness.

Operation of the pixel circuit PC_EVEN in the even row is substantially the same as the operation of the pixel circuit PC_ODD in the odd row. However, light is emitted in a current frame by data written in a previous frame operation.

In the simultaneous emission type pixel circuit in FIGS. 3 and 4, as the resolution of the display panel 150 and the size of the display panel 150 increase, the number of pixels in the horizontal direction increases and the load of the scan lines and the data lines increases, thereby causing an increase in RC delay. Consequently, the data write time increases and the emission time decreases. Due to the decrease in emission time light may be emitted with higher brightness during the emission period, which may result in an increase in emission current. Therefore, IR-drop between the ELVDD and the ELVSS increases and thus the power supply voltage may be increased, which results in an increase in power consumption.

In the organic light-emitting display apparatus according to the exemplary embodiment, both the pixel circuit PC_ODD in the odd row and the pixel circuit PC_EVEN in the even row perform light emission within one frame time as described above with reference to FIGS. 5 and 6. Therefore, the reduction in the data write time does not occur and the emission time is secured accordingly. In addition, since a frame frequency does not decrease, a flicker problem may not occur. Since all pixels within one frame perform light emission, the organic light-emitting display apparatus is robust against the reduction in resolution or interlaced crosstalk.

Figure 7:
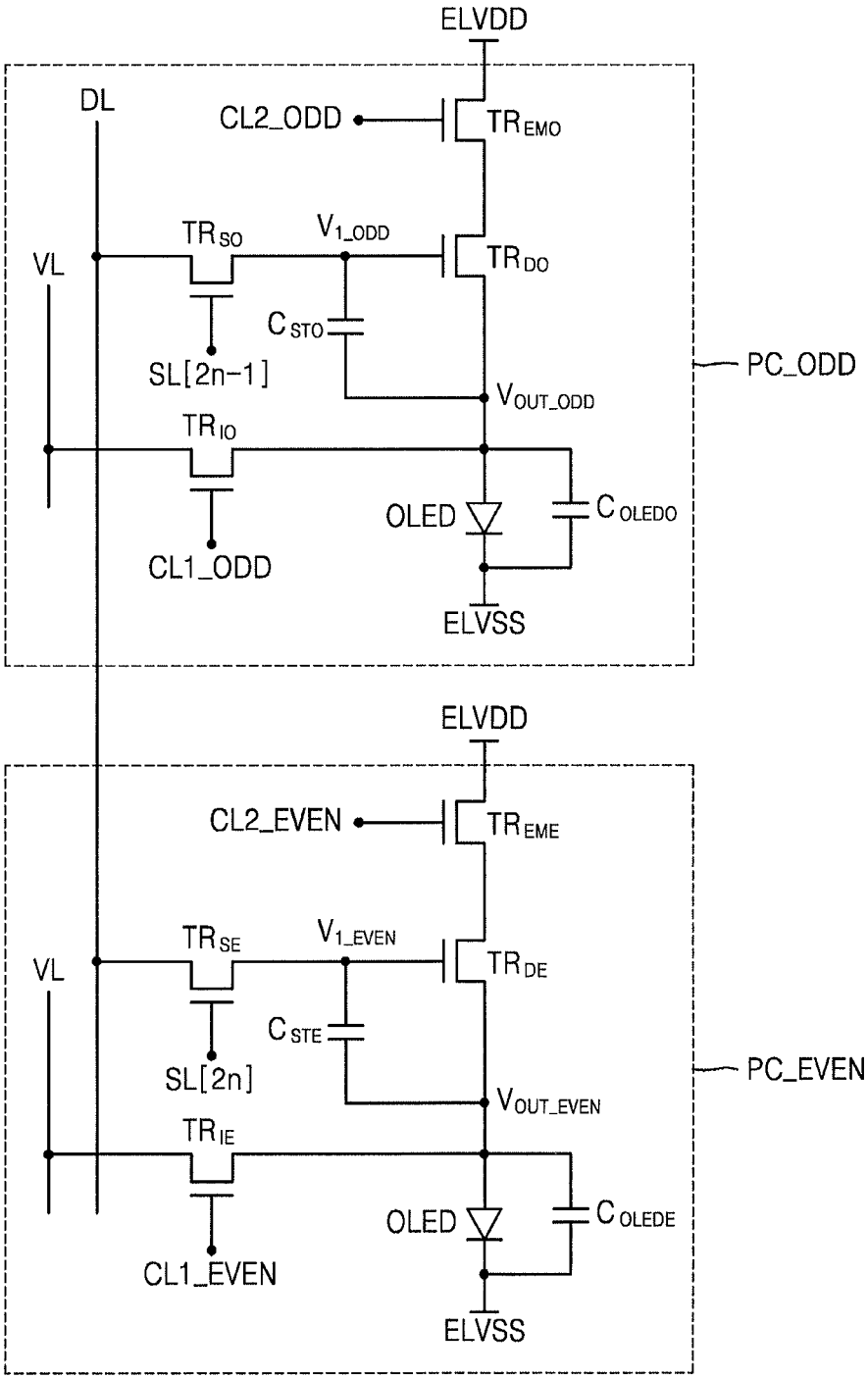
FIG. 7 illustrates another embodiment of pixel circuits.

FIG. 7 illustrates another embodiment of pixel circuits PC_ODD and PC_EVEN. In FIG. 7, the pixel circuit PC_ODD is in an odd row and the pixel circuit PC_EVEN is in an even row.

Referring to FIG. 7, an anode initialization transistor $TR_{IO}$ has a first electrode connected to an initialization voltage line VL, a second electrode connected to an output node $V_{OUT_ODD}$, and a gate electrode connected to a first control line CL1_ODD. The anode initialization transistor $TR_{IO}$ outputs an initialization voltage from the initialization voltage line VL to the output node $V_{OUT_ODD}$ based on a first control signal received through the first control line CL1_ODD.

An anode initialization transistor $TR_{IE}$ has a first electrode connected to the initialization voltage line VL, a second electrode connected to an output node $V_{OUT_EVEN}$, and a gate electrode connected to a second control line CL1_EVEN. The anode initialization transistor $TR_{IE}$ outputs an initialization voltage received from the initialization voltage line VL to the output node $V_{OUT_EVEN}$ based on a second control signal received through the second control line CL1_EVEN.

Thus, the anode initialization transistors $TR_{IO}$ and $TR_{IE}$ in the pixel circuits PC_ODD and PC_EVEN are connected to the initialization voltage line VL, instead of data line DL, and receive the initialization voltage from initialization voltage line VL.

Figure 8:
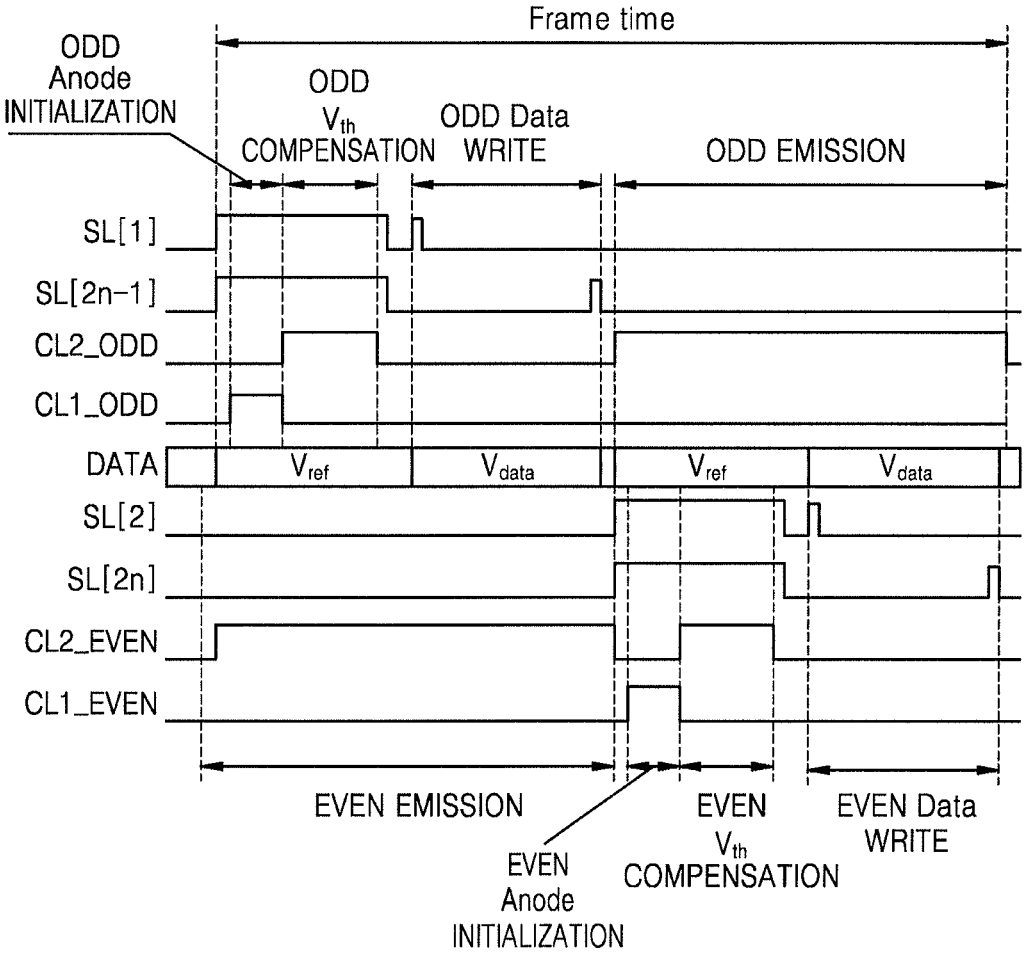
FIG. 8 illustrates an example of control signals for the pixel circuits in FIG. 7.

FIG. 8 illustrates an example of control signals for the pixel circuits PC_ODD and PC_EVEN of FIG. 7. The driving waveform of FIG. 8 is substantially similar to the driving waveform of FIG. 6, but the reference voltage $V_{ref}$ instead of the initialization voltage $V_{int}$ is applied to the data line during the anode initialization period.

Since the anode initialization transistors $TR_{IO}$ and $TR_{IE}$ of the pixel circuits PC_ODD and PC_EVEN of FIG. 5 are connected to the data line DL and receive the initialization voltage, the initialization voltage $V_{int}$ is applied to the data line DL during the initialization period.

However, since the anode initialization transistors $TR_{IO}$ and $TR_{IE}$ of the pixel circuits PC_ODD and PC_EVEN of FIG. 7 are connected to the initialization voltage line VL, instead of the data line DL, and receive the initialization voltage from the initialization voltage line VL, the initialization voltage $V_{int}$ may not be applied to the data line DL. Therefore, the reference voltage $V_{ref}$ is continuously applied to the data line DL during the anode initialization period and the threshold voltage ($V_{th}$) compensation period.

In accordance with one or more of the aforementioned embodiments, it is an organic light-emitting display apparatus increases emission time by decreasing a data write time.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. An organic light-emitting display apparatus, comprising:

a plurality of pixel circuits, each of the pixel circuits to receive a data signal and to output a driving current to an output node based on the data signal, the pixel circuits to sequentially operate in an anode initialization period, a threshold voltage compensation period, a data write period, and an emission period; and a plurality of organic light-emitting diodes to emit light based on the driving currents transferred through the output nodes of respective ones of the pixel circuits, wherein:

the pixel circuits are in multiple rows and multiple columns, each of the pixel circuits includes an anode initialization transistor to output an initialization voltage to the output node based on a first control signal received through a first control line, and the first control line connected to the anode initialization transistor of a pixel circuit in an odd row is different from the first control line connected to the anode initialization transistor of a pixel circuit in an even row, wherein the emission period of the pixel circuit in the odd row and the emission period of the pixel circuit in the even row are in a same frame and do not overlap one another.

2. The apparatus as claimed in claim 1, wherein:

each of the pixel circuits includes a capacitor, a driving transistor, a switching transistor, and an emission control transistor, the capacitor has a first electrode connected to a first node and a second electrode connected to the output node, the driving transistor has a gate electrode connected to the first node, a first electrode connected to a second electrode of the emission control transistor, and a second electrode connected to the output node, the switching transistor has a gate electrode connected to a scan line, a first electrode connected to a data line, and a second electrode connected to the first node, and the emission control transistor has a gate electrode connected to a second control line and a first electrode connected to a first power supply.

3. The apparatus as claimed in claim 2, wherein a second control line connected to an emission control transistor of the pixel circuit in the odd row is different from a second control line connected to an emission control transistor of the pixel circuit in the even row.

4. The apparatus as claimed in claim 2, wherein the anode initialization transistor has a first electrode connected to the data line and a second electrode connected to the output node, the anode initialization transistor to output a voltage from the data line to the output node based on the first control signal.

5. The apparatus as claimed in claim 2, wherein the data write period of the pixel circuit in the odd row overlaps the emission period of the pixel circuit in the even row.

6. The apparatus as claimed in claim 2, wherein the data write period of the pixel circuit in the even row overlaps the emission period of the pixel circuit in the odd row.

7. The apparatus as claimed in claim 2, wherein the anode initialization transistor is to output the initialization voltage to the output node during the anode initialization period based on the first control signal.

8. The apparatus as claimed in claim 2, wherein:

during the threshold voltage compensation period, the emission control transistor is to be turned on based on a second control signal received through the second control line and is to output a first voltage received through the first power supply to the first electrode of the driving transistor, and the switching transistor is to output a reference voltage to the first node based on a scan signal received through the scan line.

9. The apparatus as claimed in claim 8, wherein the reference voltage is to be set such that a level of a voltage applied to the output node is lower than a level of a turn-on voltage of the organic light-emitting diode.

10. The apparatus as claimed in claim 1, wherein a level of the initialization voltage is lower than a level of a turn-on voltage of the organic light-emitting diode.

11. An organic light-emitting display apparatus, comprising:

a plurality of pixel circuits, each of the pixel circuits to receive a data signal and to output a driving current to an output node based on the data signal, the pixel circuits to sequentially operate in an anode initialization period, a threshold voltage compensation period, a data write period, and an emission period; and a plurality of organic light-emitting diodes to emit light based on the driving currents transferred through the output nodes of respective ones of the pixel circuits, wherein:

the pixel circuits are in multiple rows and multiple columns, each of the pixel circuits includes an anode initialization transistor having a first electrode connected to an initialization voltage line, a second electrode connected to the output node, and a gate electrode connected to a first control line, the anode initialization transistor to output an initialization voltage from the initialization voltage line to the output node based on a first control signal received through the first control line, and a first control line connected to an anode initialization transistor of a pixel circuit in an odd row is different from a first control line connected to an anode initialization transistor of a pixel circuit in an even row, wherein the emission period of the pixel circuit in the odd row and the emission period of the pixel circuit in the even row are in a same frame and do not overlap one another.

12. The apparatus as claimed in claim 11, wherein:

the data write period of the pixel circuit in the odd row overlaps the emission period of the pixel circuit in the even row, and the data write period of the pixel circuit in the even row overlaps the emission period of the pixel circuit in the odd row.

13. The apparatus as claimed in claim 12, wherein:

an initialization voltage is applied to the initialization voltage line during the anode initialization period, and a level of the data signal is equal to a level of a reference voltage during the threshold voltage compensation period.

14. The apparatus as claimed in claim 13, wherein the reference voltage is to be set such that a level of a voltage applied to the output node is lower than a level of a turn-on voltage of the organic light-emitting diode.

15. The apparatus as claimed in claim 11, wherein a level of the initialization voltage is lower than a level of a turn-on voltage of the organic light-emitting diode.

16. A display, comprising:

a first pixel circuit to output a driving current to a first light emitter; and a second pixel circuit to output a driving current to a second light emitter;

wherein the first pixel circuit is in an odd row and the second pixel circuit is in an even row, each of the first and second pixel circuits including an anode initialization transistor to output an initialization voltage to an output node based on a first control signal from a first control line, the first control line connected to the first pixel circuit different from the first control line connected to the second pixel circuit, wherein a data write period of one of the first or second pixel circuits overlaps an emission period of another of the first or second pixel circuits.

17. The display as claimed in claim 16, wherein each of the first and second pixel circuits are to operate in an anode initialization period, a threshold voltage compensation period, a data write period, and an emission period.

18. The display as claimed in claim 17, wherein the anode initialization transistor of each of the first and second pixel circuits is to output the initialization voltage during the anode initialization period.

19. The display as claimed in claim 16, wherein a level of the initialization voltage is lower than a level of a turn-on voltage of the light emitter in each of the first and second pixel circuits.

* * * * *